United States Patent [19]

Patterson

[11] Patent Number: 4,852,990

[45] Date of Patent: Aug. 1, 1989

[54] PROCESS FOR BLEACHING DENIM FABRICS AND GARMENTS

[75] Inventor: James R. Patterson, Dunwoody, Ga.

[73] Assignee: The Virkler Company, Charlotte, N.C.

[21] Appl. No.: 88,683

[22] Filed: Aug. 24, 1987

[51] Int. Cl.[4] ..... D06L 3/06

[52] U.S. Cl. ..... 8/108.1; 8/101; 8/107

[58] Field of Search ..... 8/108.1, 107, 101; 252/174.24, 186.25, 187.23, 187.24, 187.25, 187.26, 95, 99; 162/73, 76, 87

[56] References Cited

U.S. PATENT DOCUMENTS

| | | | |
|---|---|---|---|
| 1,976,679 | 10/1934 | Fikentscher et al. | 8/6 |
| 2,692,182 | 12/1954 | Hatboro et al. | 8/115.5 |
| 3,878,037 | 4/1975 | Hansen et al. | 162/73 |
| 4,255,233 | 3/1981 | Rende et al. | 162/76 |
| 4,515,596 | 5/1985 | Berendt et al. | 8/107 |

FOREIGN PATENT DOCUMENTS

| | | |
|---|---|---|
| 2833584 | 2/1979 | Fed. Rep. of Germany . |
| 2849717 | 5/1979 | Fed. Rep. of Germany . |
| 3356 | 1/1973 | Japan . |
| 23630 | 7/1976 | Japan . |
| 62807 | 6/1978 | Japan . |
| 116491 | 9/1979 | Japan . |
| 154457 | 9/1982 | Japan . |

*Primary Examiner*—Paul Lieberman
*Assistant Examiner*—John F. McNally
*Attorney, Agent, or Firm*—Bell, Seltzer, Park & Gibson

[57] ABSTRACT

A process for bleaching fabrics or garments which produces a uniformly colored product with relatively few, less pronounced streaks is disclosed. The process requires fewer steps and increases efficiency over previous processes, while at the same time decreases the number of excessively streaked products which do not satisfy quality control standards. A preferred embodiment of the process, suited to denim fabrics or garments, comprises the steps of desizing the fabric or garment, and thereafter, without turning garments, immersing the fabric or garment in an aqueous solution containing from about 0.01 to about 10 grams per liter of a polyacrylic acid, and then adding a bleaching agent to the aqueous solution to produce a bleach bath. The fabric or garment is maintained in the bleach bath for a time sufficient to bleach the fabric or garment.

26 Claims, No Drawings

PROCESS FOR BLEACHING DENIM FABRICS AND GARMENTS

FIELD OF THE INVENTION

The present invention relates to fabric bleaching processes generally, and particularly relates to an improved bleaching process for denim goods which reduces the number of undesirable bleach streaks on the goods being treated and which can provide other special surface styling effects.

BACKGROUND OF THE INVENTION

Denim garments such as slacks, jackets and skirts are considered by many to be more fashionable once they have attained a faded, worn appearance. Accordingly, denim fabrics and garments are frequently subjected to a bleaching procedure during their manufacture to give them a bleached, superbleached, rifled or whitewashed appearance. While such prebleached goods are a very marketable product, the bleaching procedures conventionally employed are relatively labor intensive, which adds significantly to the cost of the bleaching process. Also, the conventional bleaching procedures can produce undesirably high levels of second quality goods, due primarily to streaks in the goods.

Most streaks occur along the fold lines of garments and fabrics which have been stiffened with starch sizing. At these folds, the stiffness of the sized fabric apparently spreads out the individual fibers of the fabric, subjecting these fibers to greater bleaching action. When a high quality, uniform prebleached appearance is desired, some special procedure must be employed to minimize streaking. A typical procedure is as follows: (a) garments are turned inside out to break fold lines; (b) the garments are placed in a laundry machine and desized; (c) the garments are removed from the machine and turned right-side out; (d) the garments are placed back in the laundry machine and bleached. The need for turning the garment inside out and then right-side out obviously both slows this process and adds significant labor costs. Moreover, a significant number of bleached garments will be unacceptable, even under this careful and elaborate procedure, when quality control standards are high and few streaks are tolerated. Where less rigorous quality control standards are imposed—as may be the case when some streaking is considered stylish—garments need not be turned and returned prior to bleaching. Even with this simplified procedure, it is still, nevertheless, generally necessary to desize the garment prior to bleaching, to prevent very pronounced streaks from appearing.

Accordingly, a primary object of the present invention is to provide a bleaching process which imparts a uniform prebleached appearance to garments, especially denim garments. An additional object is to provide a bleaching process which provides aesthetically pleasing surface bleaching styling effects. Still another object is to provide a bleaching process which eliminates the need for turning and returning garments so that the efficiency of the bleaching process is increased. A still further object is to provide a bleaching process for denim goods which, if desired, will produce goods having an acceptable faded appearance without even the need for desizing the goods prior to bleaching.

DESCRIPTION OF THE INVENTION

The foregoing and other objects and advantages are achieved by using a polyacrylic acid (PAA) in a bleach bath during the processing of the goods. Specifically, the present invention involves the use of PAA in what is known in the industry as a "long bath" i.e. a bath in which the ratio, by weight, of the bath itself to the goods placed in the bath is greater than 3:1, and typically ranges from about 8:1 to about 40:1.

The method of the present invention comprises the steps of immersing the fabric or garment to be bleached in an aqueous bleach bath containing a bleaching agent and a polyacrylic acid, and maintaining the fabric in the bleach bath for a time sufficient to bleach the fabric. The polyacrylic acid, discussed in greater detail below, is preferably included in a concentration of from about 0.01 to about 10 grams per liter. The bleach bath solution has a watery consistency with a noticably slippery feel which lubricates the fibers of the fabric during the bleaching cycle. An advantageous property of the polyacrylic acid is that it builds viscosity, even at relatively low concentrations. Also, it has a very low solids content so that it can be easily removed from the fabric by rinsing. Moreover, certain chemicals function as viscosity reducing agents and will destroy the viscosity building properties of the polyacrylic acid. To facilitate further processing of the garments or fabrics after bleaching, bleaching may be followed by the step of adding a viscosity-reducing agent to the bleach bath to thereby reduce the viscosity increasing effect of the PA and facilitate subsequent rinsing. Suitable viscosity-reducing agents include common salt or bisulfite, with bisulfite advantageously functioning also as an antichlor.

Although applicant does not wish to be bound to any theory of how the present invention works, the viscosity altering characteristics of the polyarylic acid appear to contribute to a more even bleaching. Our observations suggest that the presence of polyacrylic acid in the bleach bath slows down the bleaching action so that bleaching occurs during the entire bleach cycle. Without the polyacrylic acid, the bleaching occurs very quickly, immediately upon addition of the bleaching agent, with more streaks as a result. Polyacrylic acids of the type used in practicing the present invention have previously been used in textile processing applications as print paste thickeners and for producing styling effects in the dyeing of carpets, but, insofar as applicant is aware, have not previously been used in the manner disclosed herein.

The present invention is well suited for bleaching garments, particularly denim garments. When used for bleaching denim garments, the garment is preferably immersed in the bleach bath with its finished side out, thereby eliminating the need for turning the garment during the bleaching process. This provides a significant savings of labor and cost, and greatly increases the speed (throughput) of the bleaching operation. A preferred process for bleaching denim garments comprises the steps of (a) desizing the garment while the garments are right-side out and thereafter without turning the garment, (b) immersing the garment in an aqueous solution containing from about 0.01 to about 10 grams per liter of a polyacrylic acid, and then (c) adding a bleaching agent to the aqueous solution to produce a bleach bath, and then (d) maintaining the garment in the bleach bath for a time sufficient to bleach the garment. The procedure is preferably carried out in a heated bath, with a temperature of about 140 degrees Fahrenheit being typical. Through the use of this procedure, as explained in greater detail below, processing efficiency has been increased by thirty seven percent over production rates obtained with procedures requiring turning and returning of garments. At the same time, the quality of the garment finish was increased to such an extent that the number of garments rejected for excessive streaking was reduced from about fourteen percent to about five percent. When less rigorous quality control standards are applied, further cost savings can be achieved by using the inventive process without first desizing the garments, or fabrics, treated.

A suitable polyacrylic acid for use in the present invention can be easily selected. The polyacrylic acid selected should be viscosity stable at the bleach concentrations encountered during the processing of garments or fabrics in the bleach bath. The stability of various polyacrylic acids to chlorine and other bleaching agents is either known or easily determined. Polyacrylic acids for use in a preferred embodiment of this invention, where a concentrated polyacrylic acid stock solution is pumped into a bath, are also easily selected. For such a stock solution, a PAA should be selected which gives a sufficient increase in bath viscosity with a small volume of stock solution, yet gives a stock solution which is pumpable on standard equipment. By understanding the relation of viscosity to concentration in aqueous solution for various polyacrylic acids, a polyacrylic acid can be selected which provides a highly concentrated stock solution which is not so viscous that it cannot be pumped into a bleach bath, yet when the stock solution is pumped into a bleach bath and diluted, the viscosity of the bleach bath is increased. Viscosity curves giving this viscosity to concentration ratio are either known, or easily generated. To further simplify the selection of a suitable PAA for use in any embodiment of this invention, initial tests should be conducted with fabric swatches in a laboratory beaker, before commercial runs are attempted.

Through the use of the foregoing procedures, applicant selected "CARBOPOL 870" as a most preferred polyacrylic acid for carrying out this invention. "CARBOPOL 870" is a product of B.F. Goodrich Company, Specialty Polymers & Chemical Division, 6100 Oak Tree Boulevard, Cleveland, Ohio, 44131. CARBOPOL is a registered trademark of the B.F. Goodrich Company. As numerous other polyacrylic acids can easily be used to practice the present invention, this information is provided as an example only, and is not to be construed as limiting the scope of this invention. For example, the information provided by U.S. Pat. No. 2,244,703 to Hubbuch, U.S. Pat. No. 3,887,509 to Bolstad et al., U.S. Pat. No. 4,331,572 to Tomasi et al., and U.S. Pat. No. 4,386,120 to Sato et al. is all helpful in selecting polyacrylic acids useful for practicing the present invention. The disclosures of these patents are, therefore, to be incorporated herein by reference.

The following examples are provided to further illustrate the present invention. These examples are for illustrative purposes only, and are not to be taken as limiting.

EXAMPLE 1

Preparation of Concentrated PAA Stock Solution

A concentrated, aqueous polyacrylic acid solution was prepared by mixing "CARBOPOL 870" with 50% sodium hydroxide solution, at a proportion of one to one by weight, into water in a high speed mixer, while the mixer was running, along with a nonionic wetting agent. The proportions of the mixture, on a weight basis, was 8 parts "CARBOPOL 870," 8 parts sodium hydroxide and 4 parts wetting agent mixed with water to give a 12,000 centipoise solution. Though highly viscous, the solution was still capable of being pumped with standard commercial laundry equipment.

EXAMPLE 2

Bleaching of Garments

An 18 pound batch of new, sized, blue denim slacks, made from unbleached 15.5 ounce blue denim fabric, was placed in an 85 pound capacity laundering machine, and the machine filled with water heated to 140 degrees Fahrenheit. Six ounces of a nonionic softener/lubricant and six ounces of an anionic wetting agent were added, and the machine was run for five minutes. Four ounces of an enzyme desizing agent was then added, and the machine was run for an additional ten minutes. The machine was then drained and refilled with fresh water at 140 degrees Fahrenheit.

Five pounds, six ounces of the concentrated polyacrylic acid stock solution prepared in Example 1 was then added to the machine, so that the final concentration of polyacrylic acid in the machine was three tenths of a gram per liter. The machine was then run for two minutes. Two pounds of a hypochlorite bleaching agent were then added, and the machine was run for an additional ten minutes. The machine was then drained, refilled with fresh water, run for two minutes, drained again and the slacks spray rinsed. The machine was again refilled with fresh water, five ounces of sodium bisulfite, an antichlorine agent added, the machine run for five minutes, drained, and the slacks extracted for three minutes.

After extraction, the slacks were removed from the machine and inspected for defects. They were found to have a uniform prewashed appearance, and to be remarkably free of streaks along fold lines, seams, and the like. Moreover, those streaks which were present were less pronounced than those streaks found in denim slacks bleached by a conventional process, without the inclusion of a polyacrylic acid.

EXAMPLES 3-6

Effects of Varying Weight of Garment Load

The procedure described in Example 2 above was repeated with (3) an eighteen pound load of size 30" waist, 30" inseam slacks, using five pounds, six ounces of PAA stock solution and two pounds, one ounce of bleach; (4) a thirty-three pound load of size eighteen medium slacks, using nine pounds, six ounces of PAA stock solution and three pounds, fifteen ounces of bleach; (5) a twenty pound load of size seven youth's slacks, using six pounds of PAA stock solution and two pounds, six ounces of bleach; and (6) a twenty-six pound load of size eighteen medium slacks, using seven pounds, thirteen ounces of PAA stock solution and three pounds, two ounces of bleach. The quantities of both additives used during other stages of the process were adjusted according to the weight of the load, in accordance with conventional practice. The slacks were constructed of the same sized denim fabric described in Example 2.

After the bleaching procedures were completed, the slacks were inspected. The slacks were found to be uniformly bleached and without streaks. Only one dry bleach spot was observed. Accordingly, a liquid bleach system is recommended to avoid bleach spots, and to avoid any buildup of undissolved bleach in machines and drains.

The invention has been discussed with a degree of specificity above. This discussion has been provided for illustrative purposes only, with the scope of the invention being defined by the following claims.

That which is claimed is:

1. A method of textile bleaching denim fabric, comprising the steps of immersing the fabric in an aqueous bleach bath containing a chlorine bleaching agent and from about 0.01 to about 10 grams per liter of a polyacrylic acid, and maintaining the fabric in the bleach bath for a time sufficient to bleach the fabric.

2. A method according to claim 1, wherein said fabric is immersed in said aqueous solution in a solution to fabric ratio, by weight, of at least 3:1.

3. A method according to claim 1, wherein said fabric is immersed in said aqueous solution in a solution to fabric ratio, by weight, of from about 8:1 to about 40:1.

4. A method according to claim 1, wherein said aqueous solution contains about 0.3 grams of polyacrylic acid per liter.

5. A method according to claim 1, followed by the step of adding a viscosity-reducing agent to said bleach bath to thereafter facilitate further processing of said fabrics.

6. A method according to claim 5, wherein said viscosity reducing agent is selected from the class consisting of salt or bisulfite.

7. A method according to claim 1 wherein said denim fabric is in the form of a denim garment.

8. A method according to claim 7, wherein said garment is immersed in said bleach bath with the finished side of the garment facing out.

9. A method according to claim 7, wherein said garment is a sized garment.

10. A method according to claim 7, wherein said garment is a desized garment.

11. A method of bleaching a denim garment which produces a substantially uniformly colored prewashed garment, comprising the steps of (a) immersing the garment in an aqueous solution containing from about 0.01 to about 10 grams per liter of a polyacrylic acid, and then (b) adding a chlorine solution to said aqueous solution to produce a bleach bath, and (c) maintaining the garment in the bleach bath for a time sufficient to bleach the garment.

12. A method according to claim 11, wherein said garment is immersed in said aqueous solution in a solution to fabric ratio, by weight, of at least 3:1.

13. A method according to claim 11, wherein said garment is immersed in said aqueous solution in a solution to fabric ratio, by weight, of from about 8:1 to about 40:1.

14. A method according to claim 11, wherein said aqueous solution is a heated solution.

15. A method according to claim 11, further comprising the step of desizing said garment before immersing the garment in said polyacrylic acid solution.

16. A method according to claim 11, wherein said bleaching agent is a chlorine bleach.

17. A method according to claim 11, wherein said aqueous solution contains about 0.3 grams of polyacrylic acid per liter.

18. A method according to claim 11, followed by the step of adding a viscosity-reducing agent to said bleach bath to thereafter facilitate further processing of said fabrics.

19. A method according to claim 18, wherein said viscosity reducing agent is selected from the class consisting of salt or bisulfite.

20. A method of bleaching denim garments, comprising the steps of placing the garments in a vessel with an aqueous solution containing a desizing agent and agitating the vessel to desize the garments, draining the vessel and then filling the vessel with an aqueous solution containing from about 0.01 to about 10 grams per liter of a polyacrylic acid, wherein the ratio of solution to garments by weight is at least 3:1, then adding a bleaching agent to said solution and agitating the vessel for a time sufficient to bleach the garments, and then rinsing the garments.

21. A method according to claim 20, wherein said fabric is immersed in said aqueous solution in a solution to fabric ratio, by weight, of at least 3:1.

22. A method according to claim 20, wherein said fabric is immersed in said aqueous solution in a solution to fabric ratio, by weight, of from about 8:1 to about 40:1.

23. A method according to claim 20, wherein said bleaching agent is a chlorine bleach.

24. A method according to claim 20, wherein said aqueous solution contains about 0.3 grams of polyacrylic acid per liter.

25. A method according to claim 20, followed by the step of adding a viscosity-reducing agent to said bleach bath to thereafter facilitate further processing of said fabrics.

26. A method according to claim 25, wherein said viscosity reducing agent is selected from the class consisting of salt or bisulfite.

* * * * *

UNITED STATES PATENT AND TRADEMARK OFFICE

CERTIFICATE OF CORRECTION

PATENT NO. : 4,852,990

DATED : August 1, 1989

INVENTOR(S) : James R. Patterson

It is certified that error appears in the above-identified patent and that said Letters Patent is hereby corrected as shown below:

Column 2, line 31, "PA" should be -- PAA --.

Column 2, line 37, "polyarylic" should be -- polyacrylic --.

Column 5, line 13, delete "textile" and after "bleaching" insert -- a textile --.

Signed and Sealed this

Twenty-ninth Day of May, 1990

*Attest:*

*Attesting Officer*

HARRY F. MANBECK, JR.

*Commissioner of Patents and Trademarks*